United States Patent [19]

Villazon

[11] 4,041,740

[45] Aug. 16, 1977

[54] HAND TOOL

[75] Inventor: Francisco Villazon, Barcelona, Spain

[73] Assignee: AMP Incorporated, Harrisburg, Pa.

[21] Appl. No.: 755,526

[22] Filed: Dec. 30, 1976

[30] Foreign Application Priority Data

Jan. 17, 1976 United Kingdom ..... 1845/76

[51] Int. Cl.[2] ..... B21D 9/08

[52] U.S. Cl. ..... 72/410; 81/5.1 R; 81/418

[58] Field of Search ..... 72/410, 409; 81/418, 81/425 R, 425 A, 426, 427

[56] References Cited

U.S. PATENT DOCUMENTS

| | | | |
|---|---|---|---|
| 955,386 | 4/1910 | Crossman | 72/409 |
| 3,826,160 | 7/1974 | Allen | 81/418 |
| 3,859,874 | 1/1975 | Joeckel | 81/5.1 R |

*Primary Examiner*—C.W. Lanham
*Assistant Examiner*—Gene P. Crosby
*Attorney, Agent, or Firm*—Allan B. Osborne

[57] ABSTRACT

A hand tool comprises a pair of arms which are pivotally connected together at a position intermediate their ends, the parts of the arms on one side of the pivot constituting handles and the parts of the arms on the other side of the pivot constituting jaws between which an electrical connector comprising a housing with a hinged lid can be closed by movement of the handle parts of the arms towards each other, and includes a spring wire member which serves to partially close the lid of the connector prior to final closing thereof by the jaw parts.

4 Claims, 5 Drawing Figures

HAND TOOL

This invention relates to a hand tool, and particularly to a hand tool for use in the application of electrical connectors to electrical conductors.

In U.S. Pat. No. 3,835,444 there is described an electrical connector for electrically connecting the conductive cores of insulated wires, the connector comprising an insulating housing having an aperture for providing access to the interior of the housing a closure member hingedly connected to the housing at one side and movable to a closed position to close the aperture in the housing, the housing and closure members having co-operating latching members which engage to latch the closure member to the housing in the closed position, the housing containing first and second metal plates positioned with an edge of each plate facing the aperture in the housing, there being a plurality of slots opening into such edges of each plate, each slot in each plate being aligned with a slot of the other plate and being capable of receiving an insulated wire forced into the slot by the closure member as the closure member is moved to its closed position, so that edges of the slot penetrate the insulation of the wire to make electrical contact with the conductive core of the wire, there being a wire severing edge associated with only one slot of at least one of the pairs of aligned slots and disposed on the side of the slot remote from the other slot of the aligned pair, the or each wire serving edge being positioned for co-operation with the closure member to trim a wire received in the associated slot as the wire is forced into the slot by the closure member.

The housing has wire receiving notches each aligned with an individual one of the slots, each notch receiving a portion of the closure member when the aperture has been closed by the closure member.

Such a connector is especially suitable for interconnection of the wires of multi-wire telephone cables to provide splice or tap connections thereon.

As is apparent from the above, use of such a connector requires the wires to be connected to be positioned over the slots in the metal plates, each wire being over a slot in each plate, the closure member then being urged towards the housing thereby to urge the wires into the slots in the metal plates, until the latching members on the closure member and housing engage and latch the closure member and housing together.

This operation is preferably carried out by the use of a hand tool of the pliers type, that is a hand tool comprising a pair of arms which are pivotally connected together at a position intermediate their ends, the parts of the arms on one side of the pivot constituting handles and the parts of the arms on the other side of the pivot constituting jaws between which a workpiece can be compressed by movement of the handle parts of the arms towards each other.

Clearly with a connector of the type discussed above it is essential for the closure member to be correctly positioned over the aperture in the housing prior to urging the closure member towards the housing with a hand tool as discussed above, since otherwise an operation of the tool the closure member and/or the housing may be damaged, and bad or even no connections made.

According to this invention a hand tool of the type discussed above includes a spring wire member having one end secured to an arm of the tool adjacent the pivot and extending away from the pivot between the jaw parts of the tool, the spring wire member being bowed outwardly of one arm towards the other arm, and having its free end extending through a guide on the one arm, the guide permitting movement of the spring wire member therethrough towards the free ends of the jaw parts, the bowed portion of the spring wire member being engageable by the other arm of the tool as the jaw parts of the tool approach each other, thereby to urge the spring wire member through the guide such that the free end of the spring wire member passes over a recess in the jaw part of said one arm of the tool, before the jaw parts of the tool reach their most closed position. Thus, with a hand tool according to this invention, when the tool is operated with a connector as discussed above positioned in the recess, with the hinge between the closure member and the housing of the connector adjacent the pivot between the arms of the tool and extending parallel to the axis of the pivot, the free end of the spring wire member will engage the closure member of the connector and turn the closure member about the hinge such that when the closure member is engaged by the jaw part of the tool, the closure member will be positioned relative to the housing of the connector such as to ensure correct closing of the closure member onto the housing to effect the required connections.

A hand tool according to the invention will now be described by way of example with reference to the drawing in which.

Figure 1:
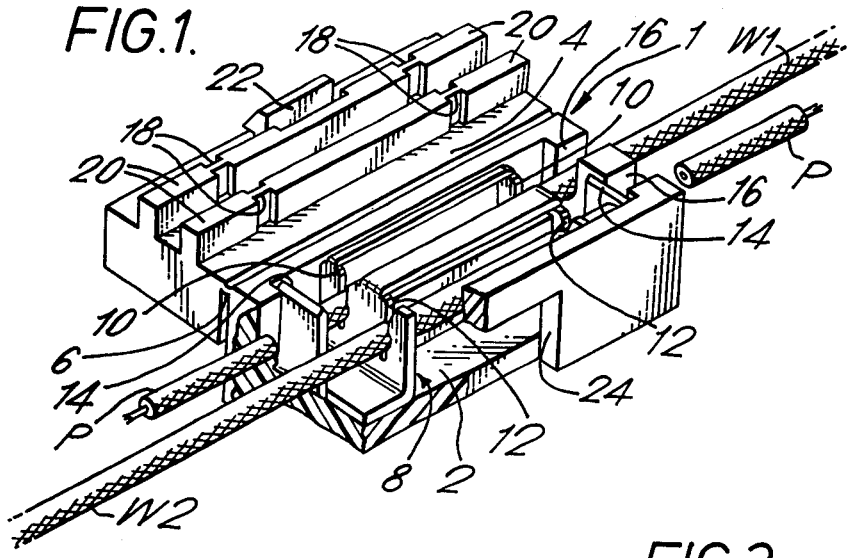
FIG. 1 is a perspective view, with part broken away of an electrical connector for splicing a pair of wires which are shown in an assembled position in the connector.
Figure 5:
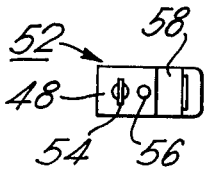
FIG. 5 is a view on the line V—V in FIG. 2.

An electrical splice connector 1 shown in FIG. 1 comprises an insulating housing 2 formed as a box, and having an integrally formed closure member in the form of a lid 4 which is pivotally connected to the housing 2 by a hinge 6. In the housing there is an electrical terminal 8 stamped and formed from sheet metal and presenting two pairs of aligned slots 10 and 12 respectively, each pair of slots having associated therewith a wire servicing edge 14.

In order to splice insulated wires W1 and W2 by means of the connector 1, the wires are laid in guide grooves 16 (only two of which are shown) formed in the ends of the housing 2 so that the wire W1 lies across the mouths of the slots 10, and the wire W2 lies across the mouths of the slots 12. The lid 4 is then closed so that wire stuffer members 18 thereon force the wires W1 and W2 into their respective pairs of slots 10 and 12 so that the edges of the slots penetrate the insulation of the wires, and thus make electrical contact with the electrically conducted cores of the wires. During closure of the lid, an end portion P of each wire is severed by cooperation between a wire severing block 20 on the lid 4 and one of the edges 14.

The wires W1 and W2 are shown in FIG. 1 in the position after they have been forced into the slots 10 and 12 of the terminal 8, and have been severed as mentioned above. When the lid 4 has been fully closed, a resilient latch member 22 on the lid 4 engages in an opening 24 in the housing 2 so that the lid 4 is firmly held in its closed position, and the wires W1 and W2 are permanently spliced. The interior of the housing may be provided with a sealant material (not shown) to preserve the spliced connection against the ingress of moisture.

Referring now to FIGS. 2 to 5 the tool according to the invention is of the pliers type, and comprises a pair of arms 26 and 28 which are pivotally connected together at a position 30 intermediate their ends, the parts 32 and 34 of the arms 26 and 28 on one side of the pivot 30 constituting handles, and the parts 36 and 38 of the arms 26 and 28 on the other side of the pivot 30 constituting jaws between which a workpiece (such as a connector as shown in FIG. 1) can be compressed by movement of the handle parts 32 and 34 of the arms 26 and 28 towards each other.

In the particular tool shown in the drawings the arm 26 is formed of two pivotally connected parts, and the tool is provided with means to vary the distance between the jaws of the tool when at their most closed position and to lock the jaws in their most closed position on operation of the tool, this means comprising a bolt 40 threadingly engaged in the free end of the handle part 34, a lever 42 pivotally connected to the handle part 32 and having its free end in engagement with the inner end of the bolt 40, and a tension spring 44 acting between the handle part 34 and the jaw part 36.

The tool also includes a further lever 46 pivotally connected to the handle part 32, and which is used to release the tool from a workpiece clamped between the jaws.

These features of the tool being described are well known and form no part of the present invention, and will not therefore be described in detail herein.

The arm 28 and the handle part 32 of the arm 32 are channel shaped in cross-section, while the jaw part 36 of the arm 26 is of thinner cross-section and is received in the channel section arm 28 at the pivot 30, and in the channel section handle part 32 where it is pivotally connected thereto.

The tool also includes a spring wire member 48 having one end secured to the jaw part 36 of the arm 26 by means of a screw 50, adjacent the pivot 30. The wire 48 extends away from the pivot 30 between the jaw parts 36 and 38, and is bowed outwardly of the arm 28 towards the jaw part 30.

Secured to the jaw part 38 is a bed member 52 (see FIG. 5) which has two pegs 54 and 56 upstanding therefrom in line with the axis of the arm 28. The peg 54 has an aperture near its free end, and serves as a guide, the free end of the wire 48 extending through the aperture. The peg 56 is shorter than the peg 54 and serves to support the free end of the wire 48 where it extends through the aperture in the peg 54. The bed member 52 also contains a recess 58 dimensioned to receive the housing of a connector as shown in FIG. 1, and will be described later.

Figure 3:
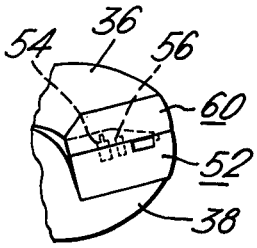
FIG. 3 is a view similar to FIG. 2 but showing only the jaws of the tool in a closed condition.
Figure 4:
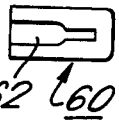
FIG. 4 is a view on the line IV—IV in FIG. 2.

Secured to the jaw part 36 is a bed member 60 (see FIG. 4) which has a slot 62 in its outwardly facing surface, which slot 62 receives the wire 48 and the pegs 54 and 56 when the jaw parts are closed together (see FIG. 3).

The above described tool is used as follows.

A connector 1 as shown in FIG. 1 is positioned on the bed member 52 with the housing 2 of the connector received in the recess 58 with the hinge 6 nearest the pivot 30 of the tool. The lid 4 of the connector 1 thus extends substantially normally away from the bed member 52 and close to the free end of the wire 48.

The wires W1 and W2 (FIG. 1) are then positioned on the housing 2, and the handle parts 32 and 34 of the tool then urged together.

As the handle parts 32 and 34 move towards each other the jaw parts 36 and 38 also move towards each other, and the bowed portion of the wire 48 engages the jaw part 36. The wire 48 is thus urged through the aperture in the guide peg 54 such that the free end of the wire 48 engages the lid 4 of the connector 1 mounted on the tool, and urges the lid 4 towards its closed position.

When the lid 4 has been thus moved part of the way to its closed position, the lid 4 is engaged by the bed member 60 on the jaw part 36 such that the connector 1 is compressed between the bed members 52 and 60 thereby to close the lid 4 completely, and thus effect the required connection between the wires W1 and W2 as described above with reference to FIG. 1.

Figure 2:
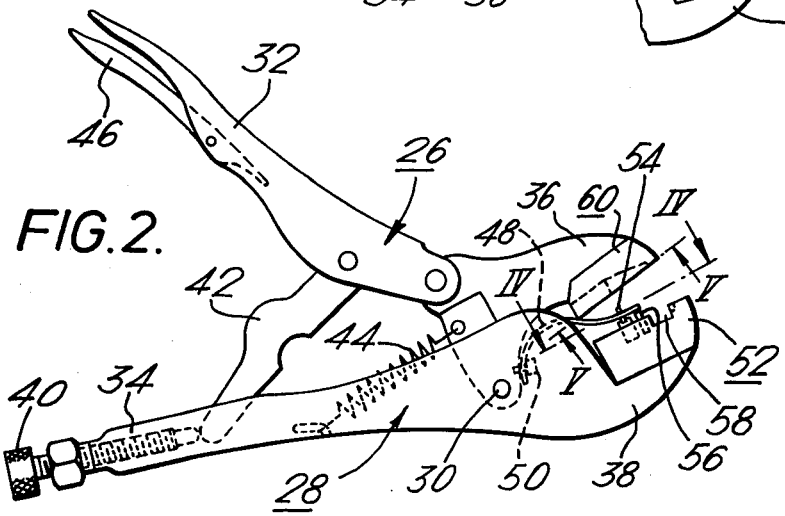
FIG. 2 is a side elevation view of a hand tool according to the invention with the jaws open.

It can be seen from FIG. 2 that the slot 62 has a sloping bottom surface which serves to guide the free end of the wire 48 as the lid 4 is partially closed thereby.

When the connection has been made the tool is released from the connector 1 which is then removed and replaced by the next connector to be applied.

What is claimed is:

1. A hand tool comprising a pair of arms which are pivotally connected together at a position intermediate their ends, the parts of the arms on one side of the pivot constituting handles and the parts of the arms on the other side of the pivot constituting jaws between which a workpiece can be compressed by movement of the handle parts of the arms towards each other, and including a spring wire member having one end secured to an arm of the tool adjacent the pivot and extending away from the pivot between the jaw parts of the tool, the spring wire member being bowed outwardly of one arm towards the other arm, and having its free end extending through a guide on the one arm, the guide permitting movement of the spring wire member therethrough towards the free ends of the jaw parts, the bowed portion of the spring wire member being engageable by the other arm of the tool as the jaw parts of the tool approach each other, thereby to urge the spring wire member through the guide such that the free end of the spring wire member passes over a recess in the jaw part of said one arm of the tool before the jaw parts of the tool reach their most closed position.

2. A hand tool as claimed in claim 1, in which secured to the jaw part of said one arm is a bed member which has two pegs upstanding therefrom in line with the axis of said one arm, the peg nearer the pivot having an aperture near its free end through which aperture the free end of the spring wire member extends, the peg nearer the pivot thus constituting said guide, and the other peg being shorter than the peg nearer the pivot and serving to support the free end of the spring wire member.

3. A hand tool as claimed in claim 2 in which the bed member of the jaw part of said one arm contains said recess.

4. A hand tool as claimed in claim 2, in which secured to the jaw part of said other arm is a bed member which has a slot in its outwardly facing surface which slot receives the spring wire member and said pegs when the jaw parts are closed together.

* * * * *